US011418869B2

(12) United States Patent
Yamaki et al.

(10) Patent No.: US 11,418,869 B2
(45) Date of Patent: Aug. 16, 2022

(54) SPEAKER DIAPHRAGM

(71) Applicant: Foster Electric Company, Limited, Tokyo (JP)

(72) Inventors: Shintaro Yamaki, Tokyo (JP); Takashi Matsumura, Tokyo (JP); Minoru Horiguchi, Tokyo (JP)

(73) Assignee: Foster Electric Company, Limited, Tokyo (JP)

( * ) Notice: Subject to any disclaimer, the term of this patent is extended or adjusted under 35 U.S.C. 154(b) by 0 days.

(21) Appl. No.: 17/274,971

(22) PCT Filed: Sep. 12, 2019

(86) PCT No.: PCT/JP2019/035952
§ 371 (c)(1),
(2) Date: Mar. 10, 2021

(87) PCT Pub. No.: WO2020/059638
PCT Pub. Date: Mar. 26, 2020

(65) Prior Publication Data

US 2022/0038809 A1 Feb. 3, 2022

(30) Foreign Application Priority Data

Sep. 18, 2018 (JP) ..... JP2018-173208

(51) Int. Cl.
*H04R 1/10* (2006.01)
*H04R 7/12* (2006.01)
*H04R 7/18* (2006.01)

(52) U.S. Cl.
CPC ..... *H04R 1/1075* (2013.01); *H04R 7/127* (2013.01); *H04R 7/18* (2013.01)

(58) Field of Classification Search
CPC ..... H04R 7/22; H04R 7/127; H04R 9/06
See application file for complete search history.

(56) References Cited

U.S. PATENT DOCUMENTS 6,188,774 B1 2/2001 Sabato et al.
8,442,259 B2 * 5/2013 Williamson ..... H04R 7/20 381/423

(Continued)

FOREIGN PATENT DOCUMENTS

CN 1242921 A 1/2000
CN 1951149 A 4/2007

(Continued)

OTHER PUBLICATIONS

Office Action dated Dec. 2, 2021 issued by the State Intellectual Property Office of People's Republic of China for Chinese Application No. 2019800606559.

*Primary Examiner* — Sunita Joshi
(74) *Attorney, Agent, or Firm* — Allen, Dyer, Doppelt & Gilchrist P.A.

(57) ABSTRACT

A diaphragm has a configuration including a diaphragm main body, a cone part on an outer periphery of the diaphragm main body, a ring member joined to the cone part, and an edge having an inner periphery joined to an outer periphery of the ring member or an outer periphery of the cone part. This configuration improves the rigidity without changing the shape of the diaphragm main body, that is, without giving rise to a mass increase in the diaphragm main body, and keeps the sound pressure from decreasing in a high frequency range.

7 Claims, 6 Drawing Sheets

(56) References Cited

U.S. PATENT DOCUMENTS

| | | | | |
|---|---|---|---|---|
| 9,277,324 | B2 | 3/2016 | Azmi | |
| 2005/0226459 | A1* | 10/2005 | Tomiyama | H04R 7/18 381/424 |
| 2006/0088184 | A1 | 4/2006 | Ohashi | |
| 2007/0183619 | A1 | 8/2007 | Kuribayashi | |
| 2007/0297640 | A1 | 12/2007 | Ohashi et al. | |
| 2008/0053745 | A1* | 3/2008 | Tada | H04R 1/24 181/165 |

FOREIGN PATENT DOCUMENTS

| | | | | |
|---|---|---|---|---|
| JP | S49-145624 | U | | 12/1974 |
| JP | 50144426 | | | 11/1975 |
| JP | 5329137 | | | 7/1978 |
| JP | S55-74296 | A | | 6/1980 |
| JP | 8102993 | | | 4/1996 |
| JP | 08102993 | A | * | 4/1996 |
| JP | 2003348691 | | | 12/2003 |
| JP | 2006217122 | | | 8/2006 |
| JP | 200910512 | | | 1/2009 |
| JP | 4999899 | | | 8/2012 |
| KR | 2010009526 | A | | 8/2010 |
| KR | 20100095256 | A | | 8/2010 |
| WO | 2014045008 | | | 3/2014 |

* cited by examiner

SPEAKER DIAPHRAGM

CROSS-REFERENCE TO RELATED APPLICATION

This application is the § 371 National Stage of International Application No. PCT/JP2019/035952, filed on Sep. 12, 2019, which claims the benefit of Japanese Patent Application Serial No. 2018-173208, filed on Sep. 18, 2018, the contents of which applications are hereby incorporated by reference in their entirety.

FIELD OF THE INVENTION

The present disclosure relates to a speaker diaphragm suitable for use in headphones.

BACKGROUND OF THE INVENTION

A speaker for use in a headphone is desired to be small and thin by itself to meet wear comfort and design demands of the headphone. Accordingly, a diaphragm for use in the speaker is also desired to be thin. For this reason, a dome-shaped diaphragm is subject to the constraint that the total height of a dome portion thereof has to be low. Such a diaphragm therefore has lower rigidity.

Existing materials of diaphragms are diverse and include novel materials and synthetic polymers such as polyolefin and polyester. In particular, paper materials (cellulose), which are excellent in terms of performance, cost, and the like, have been frequently used to the present.

As described above, the planarity of the diaphragm increases with a decrease in the thickness of the speaker. This shape constraint makes it difficult to ensure rigidity of the diaphragm, which includes cellulose as a main material, and causes breakup mode in the diaphragm. Due to the influence of the breakup mode, as shown in FIG. 6, the sound pressure has peaks and dips (mountains or valleys) in a high frequency range. Thus, the sound pressure decreases and frequency characteristics degrade.

In order to overcome this problem, various diaphragms improved in rigidity have been provided.

Patent Document 1: Japanese Patent No. 4999899

Patent Document 2: U.S. Pat. No. 9,277,324

Patent Document 3: WO 2014/045008

Patent Document 4: Japanese Unexamined Patent Publication No. S50-144426

A diaphragm disclosed in Patent Document 1 employs a free-edge structure in which a center cap part and a cone part are integrally formed.

However, even in the case of the diaphragm including the integrated center cap and cone parts, the sound pressure decays in a high frequency range due to breakup mode. A resonance point being low and being in a frequency band to be reproduced poses an issue in the reproduction.

In order to overcome this problem, methods of raising the frequency of breakup mode points have been contemplated.

In the case of a diaphragm composed of a single component such as in Patent Document 1, increasing the thickness of the diaphragm for an improvement in the rigidity results in a large overall thickness. This leads to an excessive mass increase and a decrease in the sound pressure.

Furthermore, increasing the total height results in an increase in the size. This affects the wear comfort and hinders the achievement of a desired design.

Patent Document 2 adopts a configuration including a center cap part and a ring-shaped member being a separate component provided on the outer periphery of the center cap part. Specifically, the outer periphery of the center cap part is coupled to the inner periphery of the ring-shaped member, and an edge part is coupled to the outer periphery of the ring-shaped member. Production of a diaphragm having such a configuration therefore involves complicated processes because relative positioning of parts and members is difficult.

Patent Document 3 also adopts a configuration including a center cap part and a ring-shaped member coupled to the outer periphery of the center cap part. In this diaphragm, the ring-shaped member has a dome shape and a thickness equal to or greater than twice the thickness of the center cap part to ensure the rigidity.

Since the ring-shaped member of the diaphragm disclosed in Patent Document 3 has to have a dome shape and an increased thickness, production of the diaphragm is complicated. Furthermore, an increase in the thickness accompanies a mass increase, causing a decrease in the sound pressure.

Patent Document 4 adopts a configuration including a center cap part and a reinforcement ring part joined to the inner side of the outer periphery of the center cap part.

The reinforcement ring part needs to be formed and joined so as to match the shape of the inner side of the curved outer periphery of the center cap part having a dome shape. This gives rise to a change in the shape of the center cap part, and production of such a diaphragm is complicated.

In view of the foregoing, the present disclosure has been proposed, and an object thereof is to provide a speaker diaphragm increased in rigidity and improved in frequency characteristics on a high frequency side. This diaphragm has a body member including a center cap part and a cone part on the outer periphery of the center cap part, and the rigidity thereof is easily increased without changing the shape of the body member.

SUMMARY OF THE INVENTION

A speaker diaphragm according to an embodiment of the present invention includes: a body member including a center cap part and a cone part on an outer periphery of the center cap part; a ring member joined to the cone part of the body member; and an edge having an inner periphery joined to an outer periphery of the ring member or an outer periphery of the cone part.

According to an aspect of the present invention, the center cap part has a dome shape, and the ring member having the same shape as the cone part is joined to a front surface or a back surface of the cone part.

According to another aspect of the present invention, the speaker diaphragm further includes a diaphragm fixing ring joined to an outer periphery of the edge.

According to a further aspect of the present invention, the body member and the ring member are made from a material obtained through addition of biocellulose and carbon fiber to pulp.

According to an additional aspect of the present invention, the cone part having the ring member joined thereto has a rising shape that rises frontward.

According to another embodiment of the present invention, a headphone includes the speaker diaphragm.

The embodiments and aspects of the present invention improve the rigidity of the cone part without changing the shape of the body member including the center cap part and the cone part on the outer periphery of the center cap part by joining the ring member to the cone part. This allows for management of a uniform thickness of the cone part of the body member in the circumferential direction and an increase in the rigidity of the body member even in a configuration in which the body member is thin and lightweight. This also reduces the rate of overall mass increase despite the configuration in which the ring member is joined to the cone part. Thus, the sound pressure is kept from decreasing and decaying in a high frequency range.

The increase in the rigidity of the outer periphery of the body member, which in other words is the cone part, allows for a shift of a breakup mode point toward a higher frequency range. This keeps the sound pressure from decreasing in a high frequency range, achieving an improvement in the frequency characteristics.

The cone part has a rising shape that rises frontward (toward the front of the speaker), allowing for easy radial positioning (centering) and easy production. Such a rising shape also advantageously improves the rigidity.

DETAILED DESCRIPTION OF PREFERRED EMBODIMENTS

The following describes a preferred embodiment of the present invention with reference to the drawings.

A speaker diaphragm according to an embodiment of the present invention is mainly applied to headphones. The speaker diaphragm is preferably made from a paper material and is of free-edge type.

Figure 1:
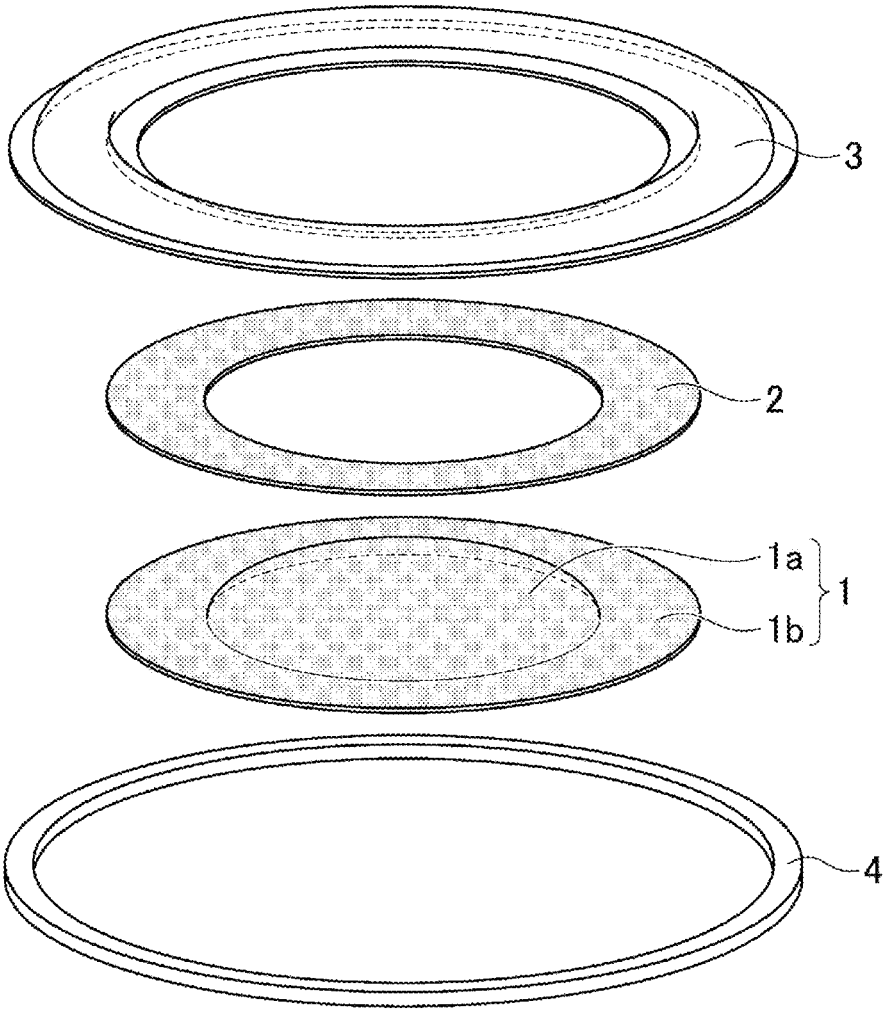
FIG. 1 is an exploded perspective view of an example of the present invention.

In FIG. 1, reference character 1 denotes a body member of a diaphragm. The body member 1 includes a dome-shaped center cap part 1*a* and a flange-shaped cone part 1*b* bulging radially outward from the outer peripheral edge of the center cap part. Reference character 2 denotes a ring member having substantially the same shape as the cone part 1*b*. The ring member 2 and the cone part 1*b* are stacked on one another and integrated by being bonded together with a urethane or rubber-based adhesive through heat-pressing. The ring member 2 is paper that is formed separately from the body member 1 into a simple flat plate shape that allows for easy production. By forming the ring member 2 and the cone part 1*b* into substantially the same shape, the present invention makes it possible to increase the rigidity of the cone part 1*b* without changing the shape of the cone part. By forming the ring member 2 into a ring shape, the present invention also makes it possible to precisely bond the ring member 2 to the ring-shaped cone part 1*b* of the body member 1, and thus to give the diaphragm a configuration that is uniform in the circumferential direction. This allows the ring member 2 to be bonded to the entire periphery of the cone part 1*b* of the body member 1. Thus, the entirety of the body member 1 can move in phase. Note that the ring member 2 is bonded to a front surface of the cone part 1*b* in FIG. 1. However, the ring member 2 may be bonded to either the front surface or a back surface of the cone part 1*b*.

The ring member 2 and the body member 1 including the center cap part 1*a* and the cone part 1*b* are preferably made from the same material, which for example is a material improved in rigidity through addition of biocellulose and a carbon fiber reinforcing material in predetermined amounts to pulp (cellulose) such as wood pulp or non-wood pulp. The reinforcing material is not limited to being microfiber or carbon fiber, and other reinforcing materials may be used.

The amounts of the biocellulose and the reinforcing material such as carbon fiber to be added to the pulp are selected as appropriate to give an optimum blending ratio according to the use of the speaker diaphragm.

Furthermore, in FIG. 1, the reference character 3 denotes a ring-shaped edge having a dome cross section, and the reference character 4 denotes a metal diaphragm fixing ring.

The inner periphery of the edge 3 is joined to the outer periphery of the ring member 2 or the outer periphery of the cone part 1*b* with an adhesive. The diaphragm fixing ring 4 in a state illustrated in FIG. 1 is located on the back side of the edge 3 and joined to the outer periphery thereof. However, the diaphragm fixing ring 4 may be located on the front surface of the edge 3 under certain circumstances.

Figure 2:
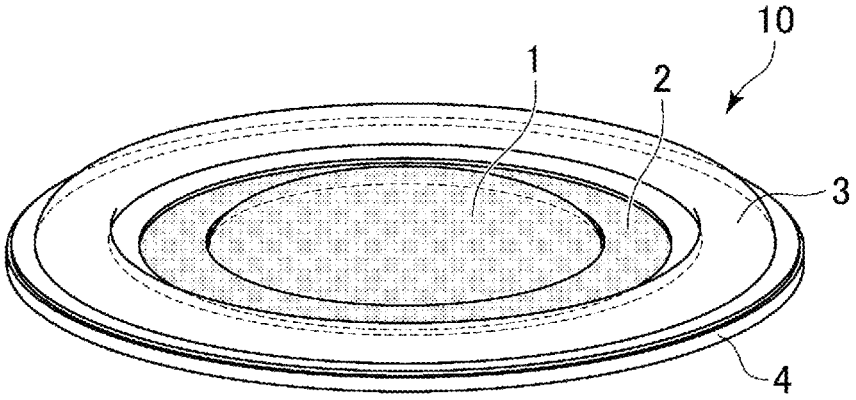
FIG. 2 is a perspective view of the example in an assembled state.
Figure 3:
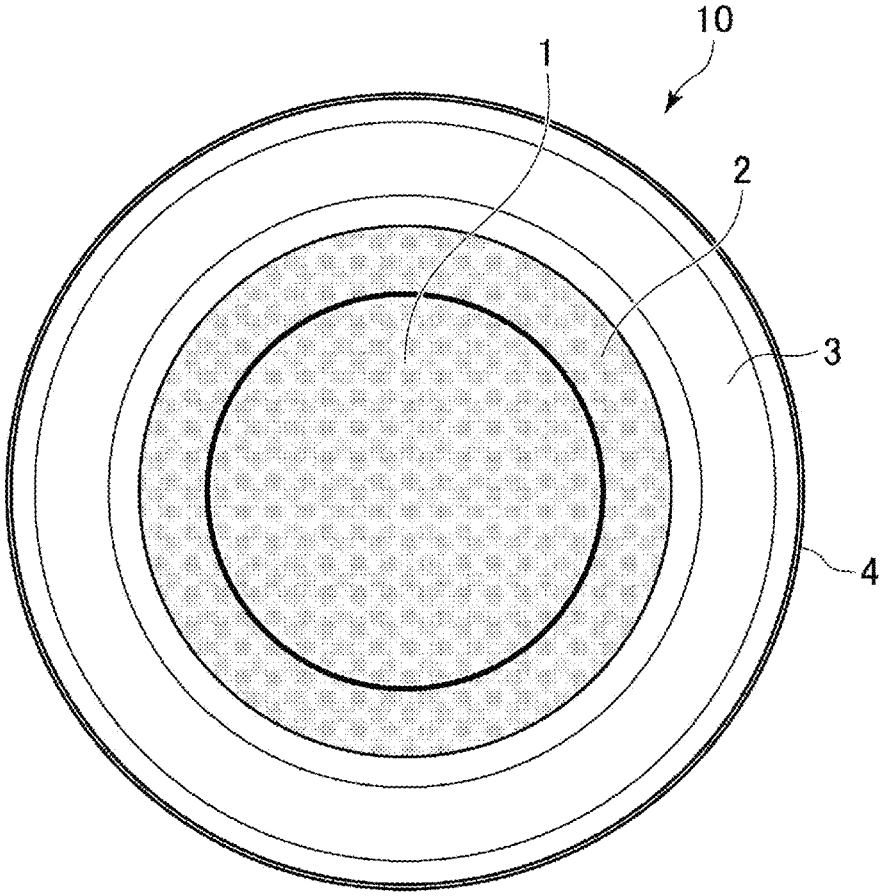
FIG. 3 is a plan view of the example.

FIGS. 2 and 3 are respectively a perspective view and a plan view of the speaker diaphragm in an assembled state.

Figure 4:
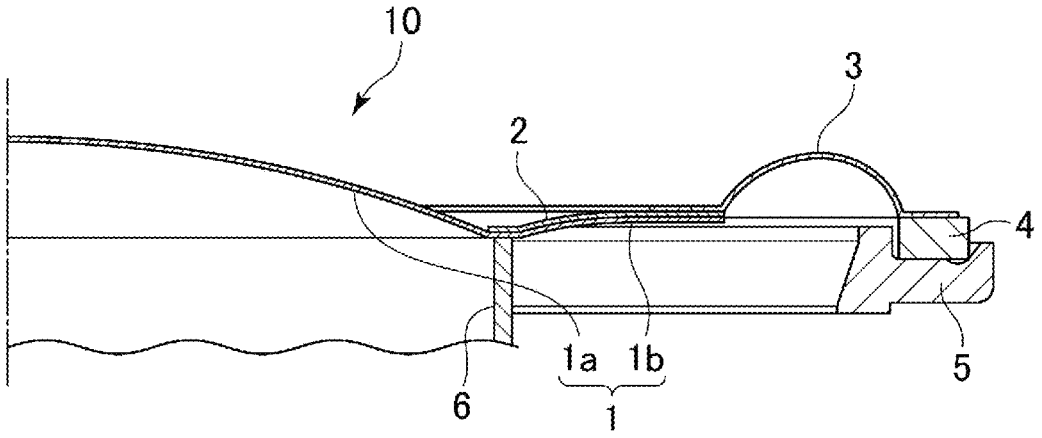
FIG. 4 is a half cross-sectional view of the example.

FIG. 4 is a half cross-sectional view of the speaker diaphragm 10 in a state in which the diaphragm fixing ring 4 bonded thereto is disposed on a speaker frame 5, and a voice coil bobbin 6 is joined to the back surface of the boundary between the center cap part 1*a* and the cone part 1*b* of the body member 1.

The cone part 1*b* having the ring member 2 joined thereto has a rising shape that rises toward the front of the speaker. This configuration facilitates positioning (centering). This configuration therefore facilitates production. The rising shape of the cone part 1*b* also rises from the inner periphery toward the outer periphery. The rigidity resulting from the shape of the cone part increases with an increase in the angle of the rising shape.

The vertex of the center cap part 1*a* is at a position higher than the outer periphery of the cone part 1*b* having the rising shape. However, in the case of a model that is not subject to height constraint, the outer periphery of the cone part 1*b* may be at a position higher than the vertex of the center cap part 1*a*.

Note that, as is well known, a voice coil is wound around the outer periphery of the voice coil bobbin 6, and the voice coil is disposed in a magnetic gap of a magnetic circuit (both not shown) to form a headphone speaker. Upon input of a sound signal to the voice coil, the speaker diaphragm 10 having the above-described configuration and coupled to the voice coil bobbin oscillates and emits sound.

Note that the term "headphones" refers to speakers that are worn on or around a head, and is not limited to those that cover ears, such as overhead headphones. Headphones include so-called earphones, such as canal headphones, in-ear headphones, and behind-the-ear headphones. The voice coil may be joined to the speaker diaphragm 10 with the interposition of the voice coil bobbin 6 or may be directly joined to the speaker diaphragm 10 without the interposition of the voice coil bobbin 6. Directly joining the voice coil to the speaker diaphragm 10 allows for a weight reduction.

Figure 5:
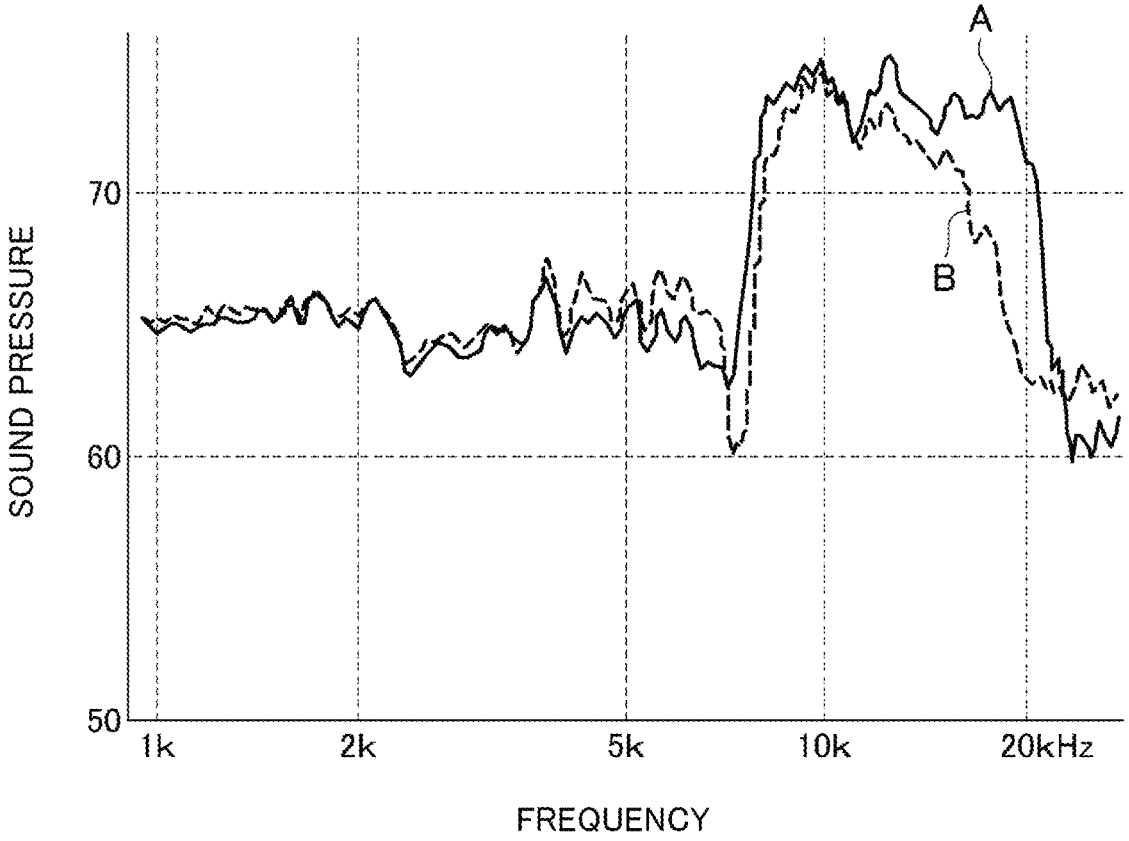
FIG. 5 is an explanatory diagram showing frequency characteristics of an example of the present invention.
Figure 6:
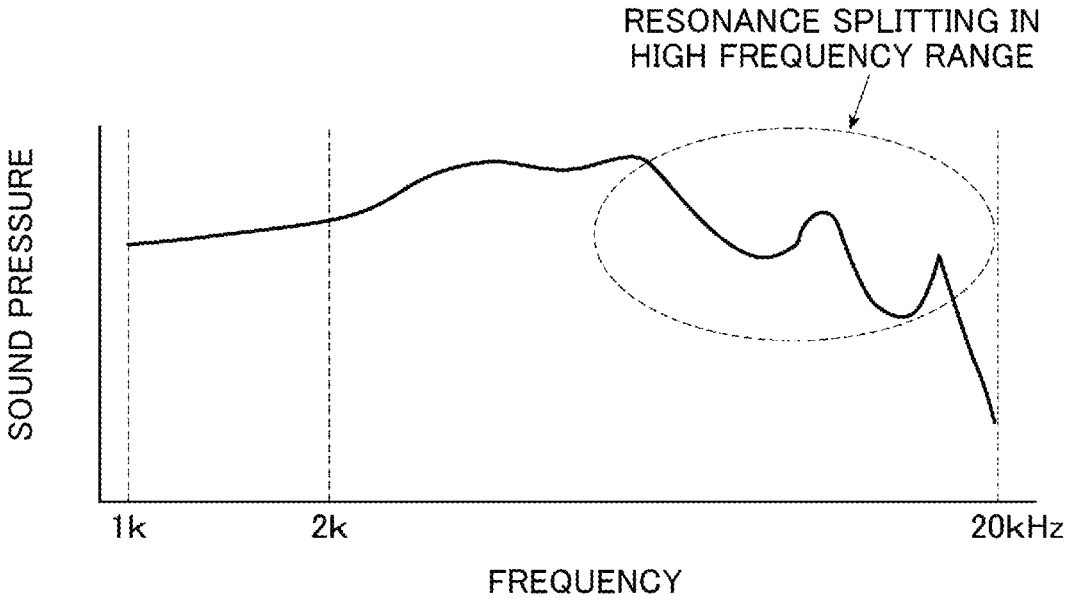
FIG. 6 is an explanatory diagram of frequency characteristics of a conventional example.

FIG. 5 shows a comparison between the frequency characteristics of the speaker diaphragm according to the present invention and the frequency characteristics of a conventional speaker diaphragm composed of a single component formed from a paper material. A solid line A represents Invention Example, and a broken line B represents Conventional Example. Note that the frequency characteristics shown in FIG. 5 were measured in an anechoic chamber. Invention Example A and Conventional Example B were produced using paper materials each having a different basis weight and containing pulp, carbon fiber, and biocellulose at the same blending ratio.

With respect to each of the speaker diaphragms of Invention Example A and Conventional Example B, the state of oscillation at 10 kHz and 12 kHz was observed. Both of the diaphragms of Invention Example A and Conventional Example B exhibited excellent sound pressure characteristics at 10 kHz as shown in FIG. 5, with the center cap part 1*a* and the cone part 1*b* in each of A and B oscillating in phase. At 12 kHz, the center cap part 1*a* and the cone part 1*b* in the diaphragm of Invention Example A oscillated in phase, whereas the center cap part 1*a* and the cone part 1*b* in the diaphragm of Conventional Example B oscillated in anti-phase. As described above, the center cap part 1*a* and the cone part 1*b* in the speaker diaphragm of Invention Example A oscillate in phase even at 12 kHz, successfully reducing breakup mode. This enables Invention Example A to have better sound pressure characteristics than Conventional Example B even at 12 kHz in a high frequency range over 10 kHz as shown in FIG. 5.

Various experiments were performed on the paper material of Conventional Example B to find that blending specifics giving a basis weight of 50 g/m$^2$ through addition of carbon fiber and biocellulose to pulp were the best for a speaker having an aperture diameter (outer diameter of the diaphragm fixing ring) φ of 14 mm. However, even such specifics resulted in a decrease in the sound pressure in the high frequency range over 10 kHz in the frequency characteristics. Another speaker diaphragm, not shown, was composed of a single component formed from a paper material having the same material blending ratio as in Conventional Example B and having a basis weight of 75 g/m$^2$. This speaker diaphragm resulted in a mass increase and a decrease in the sound pressure in all frequency ranges.

By contrast, the specifics of Invention Example A having the same aperture diameter, in which the ring member 2 having a basis weight of 40 g/m$^2$ was joined to the cone part 1*b* of the body member 1 having a basis weight of 40 g/m$^2$, successfully reduced the rate of mass increase and brought about favorable frequency characteristics by ensuring sufficient sound pressure at frequencies up to approximately 20 kHz.

Note that, as described above, the frequency characteristics of this example are finely adjustable by varying the blending ratio of carbon fiber and biocellulose relative to pulp.

The rigidity of the illustrated example, in which one ring member 2 is bonded to the cone part 1*b*, is also adjustable by adopting a structure including a plurality of ring members bonded to the cone part 1*b*.

Furthermore, the combination of the body member 1 and the ring member 2 is not limited to those made from the same material, and may be those made from different materials, such as a resin and a metal.

DESCRIPTION OF REFERENCE CHARACTERS

10 Speaker Diaphragm
1 Body Member
1*a* Center Cap Part
1*b* Cone Part
2 Ring Member
3 Edge
4 Diaphragm Fixing Ring
5 Frame
6 Voice Coil Bobbin (Voice Coil)
A Invention Example
B Conventional Example

The invention claimed is:

1. A speaker diaphragm comprising:

a body member including a center cap part and a cone part on an outer periphery of the center cap part, the outer periphery of the center cap part having an outer periphery diameter;

a ring member joined to the cone part of the body member, the ring member defining a central aperture having a central aperture diameter, the central aperture diameter of the ring member and the outer periphery diameter of the central cap part being equal; and an edge having an inner periphery joined to an outer periphery of the ring member or an outer periphery of the cone part.

2. The speaker diaphragm of claim 1, wherein the center cap part has a dome shape, and the ring member having the same shape as the cone part is joined to a front surface or a back surface of the cone part.

3. The speaker diaphragm of claim 1, further comprising:

a diaphragm fixing ring joined to an outer periphery of the edge.

4. The speaker diaphragm of claim 1, wherein the body member and the ring member are made from a material obtained through addition of biocellulose and carbon fiber to pulp.

5. The speaker diaphragm of claim 1, wherein the cone part having the ring member joined thereto has a rising shape that rises frontward.

6. A headphone comprising the speaker diaphragm of claim 1.

7. The speaker diaphragm of claim 1, wherein respective diameters of the outer peripheries of the cone part and the ring member are equal.

* * * * *